US005417108A

United States Patent [19]

Chastonay

[11] Patent Number: 5,417,108

[45] Date of Patent: May 23, 1995

[54] METHOD FOR DYNAMICALLY BALANCING GOLF CLUBS ON A CONVENTIONAL SWING WEIGHT SCALE USING RADIUS OF GYRATION AS THE CONTROLLING PARAMETER

[76] Inventor: Herman A. Chastonay, 6455 Potomac, St. Louis, Mo. 63139

[21] Appl. No.: 178,090

[22] Filed: Jan. 6, 1994

[51] Int. Cl.[6] ..... A63B 53/00

[52] U.S. Cl. ..... 73/65.03; 273/80 A

[58] Field of Search ..... 73/65.03; 273/77 A, 273/80 A, 81 A

[56] References Cited

U.S. PATENT DOCUMENTS

| | | | |
|---|---|---|---|
| 3,577,771 | 5/1971 | Solheim | 73/65.03 |
| 3,698,239 | 10/1972 | Everett, III | 73/65.03 |
| 4,058,312 | 11/1977 | Stuff et al. | 73/65.03 X |
| 4,203,598 | 5/1980 | Stuff et al. | 273/80 A X |
| 4,603,577 | 8/1986 | Johnson et al. | 73/65.03 |
| 4,674,324 | 6/1987 | Benoit | 73/65.03 |
| 5,094,101 | 3/1992 | Chastonay | 73/65.03 |
| 5,277,059 | 1/1994 | Chastonay | 73/65.03 |
| 5,285,680 | 2/1994 | Sun | 73/65.03 |
| 5,318,296 | 6/1994 | Adams et al. | 73/65.03 X |

*Primary Examiner*—Richard E. Chilcot, Jr.
*Assistant Examiner*—Elizabeth L. Dougherty
*Attorney, Agent, or Firm*—Haverstock, Garrett & Roberts

[57] ABSTRACT

A method for dynamically balancing a plurality of golf clubs on a conventional swing weight scale using radius of gyration as the controlling parameter wherein a specific radius of gyration/swing weight scale designation correlation is derived for a particular set or plurality of golf clubs and, thereafter, other clubs are balanced on a conventional swing weight scale in accordance with such correlation. The present method allows a user to dynamically balance one or more golf clubs to a single, selected radius of gyration, or to a radius of gyration which is driven substantially closer to the selected radius of gyration when so balanced so as to provide improved performance, control and handling characteristics as compared to other known prior art balancing methods.

11 Claims, 1 Drawing Sheet

METHOD FOR DYNAMICALLY BALANCING GOLF CLUBS ON A CONVENTIONAL SWING WEIGHT SCALE USING RADIUS OF GYRATION AS THE CONTROLLING PARAMETER

The present invention relates to a method for dynamically balancing golf clubs using radius of gyration as the controlling parameter in accordance with the dynamic equations describing compound pendulum motion as previously disclosed in Applicant's U.S. Pat. No. 5,094,101 and, more particularly, to a method wherein one first correlates a specific relationship between golf clubs dynamically balanced using radius of gyration as the controlling parameter and the various swing weight scale designations or readings associated with a conventional swing weight scale and, thereafter, balances other golf clubs on a conventional swing weight scale in accordance with the specific radius of gyration/swing weight scale designation correlation derived above for a particular set or a particular plurality of golf clubs. Although the present method is not always as accurate as the method for dynamically balancing golf clubs previously disclosed in Applicant's U.S. Pat. No. 5,094,101, the present method disclosed herein is sufficiently accurate so as to provide a greatly improved and satisfactory set of dynamically balanced golf clubs having improved performance, control, and handling characteristics as compared to other known prior art balancing methods in Applicant's U.S. Pat. No. 5,094,101 including the widely used swing weight balancing method. The present method discloses a novel use of the conventional swing weight scale which, importantly, is less time consuming as compared to Applicant's more involved and more accurate method for dynamically balancing golf clubs using radius of gyration as the controlling parameter as disclosed in U.S. Pat. No. 5,094,101.

BACKGROUND OF THE INVENTION

As explained in detail in Applicant's U.S. Pat. No. 5,094,101, a wide variety of methods for weighting and balancing golf clubs are known and have been utilized to some extent in an effort to improve the overall performance, control, and handling characteristics of a particular set of golf clubs. One of the more popular and commonly used methods for balancing a particular set of golf clubs is the swing weight method. In simple terms, swing weighting a particular set of golf clubs means bringing all of the clubs in a particular set into the same swinging balance. This means that a driver or a 2 iron, with their long shaft and lighter heads, would have the same swinging balance or feel as one of the shorter irons such as a 7 iron or 9 iron, which irons have a much shorter and heavier club head. In reality, swing weighting measures the imbalance of each golf club and allows all of the clubs in a particular set or grouping to be brought into the same imbalance.

As more fully explained in Elkins, Jr. U.S. Pat. No. 4,128,242, the generally accepted method for swing weighting a golf club is to place the particular club on a swing weight scale device which statically balances the club at a point which is either twelve (12) inches or fourteen (14) inches from the grip end of the club as best illustrated in FIG. 1. The reference letter "P" in FIG. 1 represents a pivot length of either twelve or fourteen inches measured from the grip end of the club to the fulcrum or pivot point associated with the swing weight scale device. A sliding weight mechanism allows the appropriate amount of weight to be shifted as necessary in order to balance the particular club at the twelve or fourteen inch pivot point. The amount of weight which must be shifted indicates the swing weight value or designation of each particular club.

Swing weight is measured in points. The lightest clubs in a particular set correspond to a swing weight reading in the C range, with numbers ranging from 0 through 9; medium weight clubs in a particular set correspond to a swing weight reading in the D range, with numbers ranging from 0 through 9; and the heaviest clubs in a particular set correspond to a swing weight reading in the E range, with numbers ranging from 0 through 9. The swing weight readings associated with most men's clubs fall within the range of D-0 to D-6 whereas the swing weight readings asociated with most ladies' clubs fall within the range of C-5 to D-0 on a ten-point scale. Swing weight devices utilizing a fourteen inch pivot point are calibrated to a scale known as the "Lorythmic Scale" whereas swing weight devices utilizing the twelve inch pivot point are calibrated to a scale commonly referred to as the "Official Scale". These scale designations correspond to various static moment values measured in ounce-inches in accordance with the following table:

| Swing Weight Reading | Official Scale (Static Moment) | Lorythmic Scale (ounce-inches) |
|---|---|---|
| B-0 | 200 | 170 |
| B-1 | 202 | 172 |
| B-2 | 204 | 174 |
| B-3 | 206 | 176 |
| B-4 | 208 | 178 |
| B-5 | 210 | 180 |
| B-6 | 212 | 182 |
| B-7 | 214 | 184 |
| B-8 | 216 | 186 |
| B-9 | 218 | 188 |
| C-0 | 220 | 190 |
| C-1 | 222 | 192 |
| C-2 | 224 | 194 |
| C-3 | 226 | 196 |
| C-4 | 228 | 198 |
| C-5 | 230 | 200 |
| C-6 | 232 | 202 |
| C-7 | 234 | 204 |
| C-8 | 236 | 206 |
| C-9 | 238 | 208 |
| D-0 | 240 | 210 |
| D-1 | 242 | 212 |
| D-2 | 244 | 214 |
| D-3 | 246 | 216 |
| D-4 | 248 | 218 |
| D-5 | 250 | 220 |
| D-6 | 252 | 222 |
| D-7 | 254 | 224 |
| D-8 | 256 | 226 |
| D-9 | 258 | 228 |
| E-0 | 260 | 230 |
| E-1 | 262 | 232 |
| E-2 | 264 | 234 |
| E-3 | 266 | 236 |
| E-4 | 268 | 238 |
| E-5 | 270 | 240 |
| E-6 | 272 | 242 |
| E-7 | 274 | 244 |
| E-8 | 276 | 246 |
| E-9 | 278 | 248 |

In actuality, golf clubs are never swing weighted in the A-0 to C-4 range of the swing weight scale.

As is well known, all golfers seem to have at least one particular club within any given set which they feel more comfortable with in using and in which they can more accurately control when hitting any particular golf shot. This one particular, preferred golf club is usually one of the shorter irons as proper use and control of the shorter irons are easier to achieve with some degree of regularity as compared to the longer irons and woods. Typically, a set of golf clubs will be swing weighted to a particular swing weight designation using a conventional swing weight scale as briefly explained above. Although swing weighting a particular set of golf clubs can improve a particular golfer's feel, comfortability, control and performance when using such clubs as explained in Applicant's U.S. Pat. No. 5,094,101, all known swing weight balancing methods avoid and/or circumvent the dynamic characteristics of a golf club during a swinging or oscillating motion and all such swing weight methods, in effect, represent a static balancing of such clubs.

On the other hand, although Applicant's method for dynamically balancing golf clubs using radius of gyration as a controlling parameter as disclosed in U.S. Pat. No. 5,094,101 more accurately describes and simulates the dynamic characteristics associated with swinging a particular golf club and more accurately balances such golf clubs based upon both dynamic as well as static characteristics, such method is somewhat more time consuming and tedious to achieve. In an effort to both simplify the overall balancing process and reduce the overall time involved in dynamically balancing golf clubs using radius of gyration as the controlling parameter, Applicant has devised the present compromise method for dynamically balancing golf clubs using radius of gyration as the controlling parameter while still achieving most, if not all, of the benefits and objectives of the dynamic balancing method disclosed in U.S. Pat. No. 5,094,101 including optimizing and improving the overall feel and performance characteristics of a particular set of golf clubs. The present invention utilizes the complete swing weight scale from A-0 to F-0 and correlates important dynamic characteristics of golf clubs such as radius of gyration and moment of inertia to specific swing weight scale designations as explained below.

SUMMARY OF THE INVENTION

The present invention is based and premised upon dynamically balancing golf clubs as set forth and disclosed in Applicant's U.S. Pat. No. 5,094,101 using radius of gyration as the controlling parameter and teaches a more simplified method for accomplishing this radius of gyration dynamic balancing using a conventional swing weight scale. Based upon the theory of dynamics of a rotating body, the dynamic equations for describing compound pendulum motion, and the assumptions set forth and described in Applicant's U.S. Pat. No. 5,094,101, the present more simplified method for dynamically balancing a particular golf club on a conventional swing weight scale using radius gyration as the controlling parameter comprises the following steps:

(1) Having a golfer select a reference golf club having all of the optimal parameters and performance characteristics for that particular golfer as set forth and explained in Applicant's U.S. Pat. No. 5,094,101 including ease and comfortability with respect to swing, performance and control of that particular club;

(2) Through measuring, weighting and balancing, obtaining the shaft or center of percussion length, the weight, and the center of gravity location of the reference club as explained in U.S. Pat. No. 5,094,101;

(3) Using the center of percussion equation $Q=K^2/r$ where $Q=$ shaft or center of percussion length of the club, $K=$ radius of gyration of the club, and $r=$ distance between the axis of rotation and the center of gravity of the club, calculate the radius of gyration for the reference club;

(4) Measure the shaft or center of percussion length of the driver or the longest club in the particular set or grouping of clubs to be balanced;

(5) Using the center of percussion equation, calculate the new center of gravity location for the driver or the longest club to be balanced based upon the radius of gyration of the reference club;

(6) Balancing the driver or the longest club in a conventional manner at its new center of gravity location based upon the selected radius of gyration;

(7) Placing the dynamically balanced driver or longest club on a conventional swing weight scale device and obtaining the corresponding or correlating swing weight scale designation or reading; and (8) Balancing the remainder of the particular set or group of golf clubs on the swing weight scale device at the same swing weight designation reading as the now balanced driver or the longest club, or at an incrementally higher swing weight scale designation(s), such incremental increases in swing weight designations being determined using radius of gryation as the controlling parameter.

In essence, the present invention utilizes the conventional swing weight scale device as a calibrated fulcrum to balance any particular golf club to a selected radius of gyration as indicated above by adding weight to the grip end portion of the club while the club is on the swing weight device. The actual correlation between radius of gyration and swing weight scale designation is described mathematically by a sequence formula which utilizes the swing weight static moment equation ($SW=L\times W$), the center of percussion equation ($Q=K^2/r$), and the moment of inertia equation ($I=K^2\times M$). As will be further explained hereinafter in detail, the above-identified equations are utilized in order to tie a given swing weight designation to a particular radius of gyration. Using the present sequence formula, it is not necessary to calculate the radius of gyration of the particular reference club if the associated swing weight designation for such reference club is utilized as will be hereinafter further explained. Once the appropriate swing weight designation for a selected radius of gyration has been determined, other clubs in the plurality of clubs to be balanced in accordance with the present method can be dynamically balanced to the selected radius of gyration by swing weighting such additional clubs to the corresponding new swing weight designation. This is accomplished by adding trial weights at the grip end of the club until the desired swing weight designation is obtained. Once the particular club being balanced is, in fact, balanced to the selected swing weight designation, a single permanent weight equal to the trial weight, or any other equivalent weight arrangement, is then positioned and secured inside the club shaft at the proper location so as to ensure that the club will remain in balance on the swing weight device at the selected swing weight scale designation.

Although Elkins, Jr. in U.S. Pat. No. 4,128,242 attempts to match or correlate a particular set of golf clubs according to both dynamic and static criteria, such as matching a particular set of golf clubs according to both moment and moment of inertia, such a correlation is extremely limited in that it is only applicable when balancing irons from the number 1 iron to the number 6 iron. At best, the Elkins, Jr. method balances golf clubs in a range of swing weight scale designations which is no lower than C-8. As explained in Elkins, Jr. U.S. Pat. No. 4,128,242, when more than one dynamic or more than one static matching criteria is desired, it is more difficult to find real solutions to the Elkins+ equations. In some cases, when using the Elkins, Jr. correlation method, the long irons (1, 2 and 3 irons) in the set may be made too short or the short irons (7, 8 and 9 irons) may be made too long. If the long irons are too short, insufficient club head velocity is generated and a golfer is unable to hit the ball any farther than he can with his mid-irons. On the other hand, if the short irons are made too long, the golfer either hits them too far or, after additional loft is added to reduce the distance, the golfer finds that he does not have the accuracy with the long short irons that he had had with shorter conventionally swing weight matched irons and thus, all of the benefits of combined dynamic and static matching as taught by Elkins, Jr. are lost. The same is equally true with the woods associated with any particular set of golf clubs. Thus, the most desirable or optimum set of specifications, in terms of both dynamic and static criteria, for a correlated set of clubs tends to add difficulty in finding the club parameters that satisfy the matching criteria when utilizing the Elkins, Jr. method. This is not true of the present correlated balancing method wherein any golf club in any set or plurality of golf clubs can be dynamically balanced to the radius of gyration of the selected reference club in accordance with a sequence formula which properly links a static equation and two dynamic equations. The present formulation therefore more accurately represents the correlation between swing weight designation and radius of gyration.

It is anticipated and recognized that any number of selective clubs out of a particular set of golf clubs may be balanced in accordance with the present invention to a selected radius of gyration/swing weight scale designation. For example, all of the irons in a particular set of golf clubs could be weighted and balanced to a specific radius of gyration/swing weight scale designation, or increments thereof, whereas all of the woods in the same set of golf clubs could be weighted and balanced to a different radius of gyration/swing weight scale designation, or increments thereof. Other groupings of selected clubs out of a particular set of golf clubs could likewise be balanced to specific radius of gyration values, as desired.

In accordance with the present method, if a particular group or set of golf clubs are balanced on the swing weight scale device at the same new swing weight designation as derived for the driver or longest club in that particular group, the radius of gyration associated with each such club will not remain exactly constant but will vary to some extent as will be hereinafter more fully explained. Nevertheless, even though the radius of gyration for such clubs does vary, the range of radius of gyration values associated with such clubs is still well within an acceptable and usable tolerance limit as compared to the selected radius of gyration for the longest club and, as such, such a balancing method still produces a particular set or grouping of clubs which is more in tune with and more responsive to that particular golfer's needs and preferences thereby noticeably improving the uniformity of feel and swing control experienced by such golfer. In essence, the higher radius of gyration value associated with the longer clubs in the particular set or plurality of clubs to be dynamically balanced are considerably reduced and driven much closer to the selected radius of gyration value of the golfer's reference club than any other known method for dynamically balancing golf clubs except for the method disclosed in Applicant's U.S. Pat. No. 5,094,101.

Still further, as will be hereinafter further explained, the selected radius of gyration value of the reference club can, in fact, be held substantially constant for any particular set or grouping of clubs by correlating and establishing the necessary incremental change in the swing weight scale designation starting with the longest club in such plurality of clubs to be balanced to the shortest club in such particular set as will be further explained. In this regard, since the incremental change in swing weight scale designations may not be uniform from the longest club to the shortest club in the particular set to be balanced in order to achieve identical uniformity in the radius of gyration value, an average incremental change in such swing weight scale designation can be derived so as to achieve substantial uniformity, although some acceptable variance in the selected radius of gyration value may occur. Here again, although the present compromised method for dynamically balancing a set of golf clubs does not produce as accurate a balancing method as that disclosed in Applicant's U.S. Pat. No. 5,094,101, this compromised method still produces a better matched set of golf clubs for ease of handling, performance, feel and comfortability than any of the known swing weighting methods, and such method represents a dynamic balancing of such clubs as compared to the static balancing produced using conventional swing weighting techniques.

Also, importantly, when a complete set of golf clubs have been dynamically balanced in accordance with the present method, the balance weight for each club can be used on the respective clubs of a similar set having the same club lengths associated respectively therewith. This greatly speeds up the balancing process of similar clubs and enables a conventional swing weight scale device to be used in accordance with the teachings of the present invention as an inspection tool to both monitor and ensure proper radius of gyration/swing weight balancing. In fact, balancing can be accomplished based solely upon the amount of additional balance weight added to the longest club in any particular set or grouping of clubs to be balanced, or increments thereof.

It is therefore a principal object of the present invention to provide another method for dynamically balancing any plurality of golf clubs using radius of gyration as the controlling parameter.

Another object is to provide a method for dynamically balancing golf clubs using radius of gyration as the controlling parameter wherein such balancing is accomplished on a conventional swing weight scale device.

Another object is to provide a simpler, less time consuming method for dynamically balancing golf clubs using radius of gyration as the controlling parameter as compared to the method disclosed in U.S. Pat. No. 5,094,101 while maintaining acceptable radius of gyration tolerances to achieve the stated objectives.

Another object is to teach a method for dynamically balancing golf clubs using radius of gyration as the controlling parameter wherein a correlation is established between a selected radius of gyration value and certain scale reading designations on a conventional swing weight scale device.

Another object is to teach a method for dynamically balancing golf clubs on a conventional swing weight scale wherein the radius of gyration is held substantially constant, within acceptable tolerances, for each club so balanced.

Another object is to teach a method for dynamically balancing golf clubs on a conventional swing weight scale device wherein a predetermined swing weight scale designation which was correlated to a selected radius of gyration for the longest club in a particular set or grouping of golf clubs to be balanced is held constant for each club so balanced, this particular method significantly reducing the radius of gyration value of all clubs so balanced and moving such radius of gyration values substantially closer to the selected radius of gyration for the reference club.

Another object is to teach a method for dynamically balancing any plurality of golf clubs wherein some of said plurality of golf clubs are balanced to one specific radius of gyration value, or to an acceptable range of radius of gyration values, while the remaining clubs in said set are balanced to another specific radius of gyration value, or to another acceptable range of radius of gyration values.

Another object is to provide a method for optimizing and improving the overall feel and performance characteristics of a particular set of golf clubs.

Another object is to provide a method for dynamically balancing any golf club so as to more accurately match the individual clubs in a particular set so that all such clubs "swing or feel alike".

Another object is to teach a sequence formula which mathematically describes the dynamic balancing of golf clubs on a swing weight scale device to a specific radius of gyration value that is correlated to and identified by a particular swing weight scale designation.

Another object is to provide a method for balancing the longer golf clubs on a swing weight scale device in a swing weight scale range never before utilized in conventionally swing weighting golf clubs, namely, in the swing weight scale range of A-0 to C-4.

These and other objects and advantages of the present invention will become apparent to those skilled in the art after considering the following detailed specification in conjunction with the accompanying drawings.

DETAILED DESCRIPTION OF THE INVENTION

Figure 1:
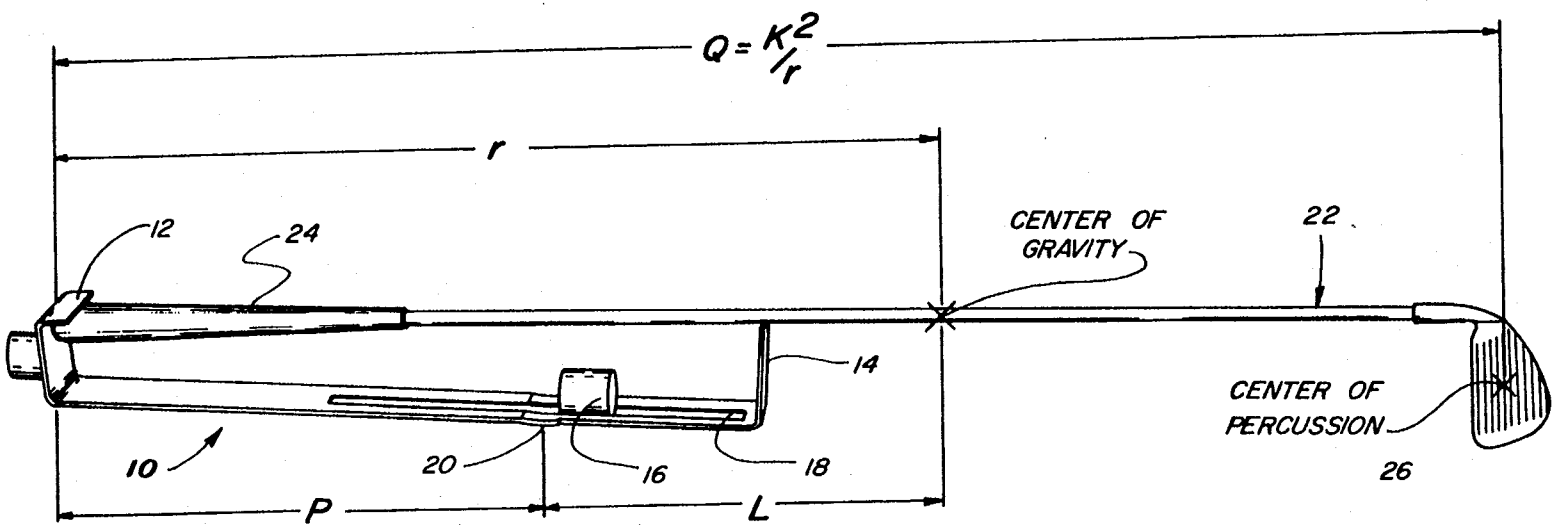
FIG. 1 illustrates a typical swing weight scale device for swing weight balancing golf clubs.
Figure 2:
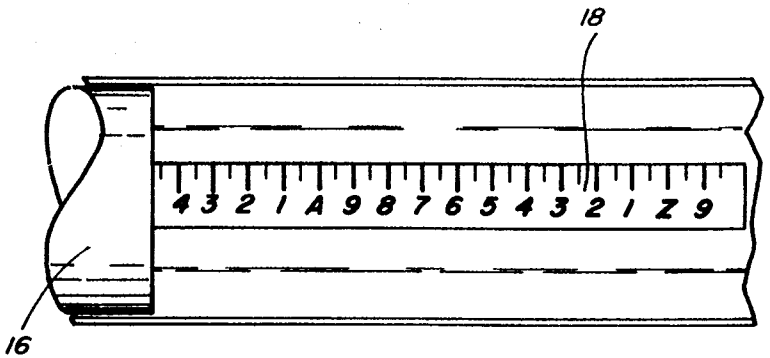
FIG. 2 is an enlarged fragmentary view of a portion of the slide weight/scale mechanism associated with the swing weight device of FIG. 1.

Referring to the drawings more particularly by reference numbers wherein like numerals refer to like parts, number 10 in FIG. 1 identifies a conventional prior art swing weight scale device commonly used to determine the swing weight of a particular golf club. The device 10 includes means in the form of the bracket members 12 and 14 for supporting a golf club in proper position on the device, a slide weight 16 which is slidably movable along a calibrated scale 18, and a pivot or fulcrum point 20. A golf club 22 is shown positioned on the device 10 in preparation for balancing in accordance with the conventional swing weight method. When the golf club 22 is positioned as illustrated in FIG. 1, the slide weight 16 is manipulated from side-to-side until the golf club is balanced about the fulcrum or pivot point 20. The position of the weight 16 relative to the calibrated scale 18 is then observed to determine the swing weight reading or designation for the club 22. In the device illustrated in FIG. 1, the swing weight scale reading or designation is read adjacent the right edge portion of the slide weight 16. For example, as illustrated in FIG. 2, the position of the slide weight 16 in FIG. 2 corresponds to a swing weight scale reading of A-4¾. Depending upon the particular swing weight device being used, the fulcrum or pivot point 20 is fixed at a distance of either twelve inches or fourteen inches from the grip end portion of the club as previously explained. In other words, referring to FIG. 1, the distance "P" is equal to either twelve inches or fourteen inches.

The first step in the present method for dynamically balancing any particular set or plurality of golf clubs again involves having a golfer select a reference club having all of the optimal design parameters and performance characteristics important to that particular golfer as previously explained in Applicant's U.S. Pat. No. 5,094,101. The selected reference club should take into account all of the preferred factors and characteristics important to that particular golfer including such parameters as the overall weight of the club, moment of inertia, center of percussion location, center of gravity location, preferred or optimal club length, the particular grip style and configuration preferred, and, most importantly, the ease, feel and comfortability with respect to swinging the reference club as well as its performance and control. Regardless of which club is selected as the reference club, it is important to remember that the above-referenced parameters with respect to the reference club is critical to the present balancing method since the reference club establishes the radius of gyration value for the remaining clubs to be balanced and the radius of gyration value is a critical factor in how a club feels and performs.

Figure 3:
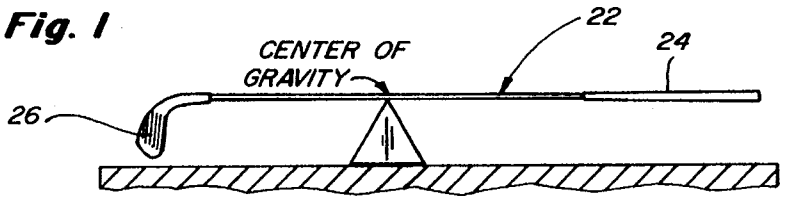
FIG. 3 is a side elevational view of a typical fulcrum device used to locate the center of gravity of a golf club along the shaft thereof.

Once the reference club has been selected in accordance with the guidelines set forth above and in U.S. Pat. No. 5,094,101, the reference club, such as the club 22 illustrated in FIG. 1, is measured and weighed to determine its mass or weight and its shaft or center of percussion length. As illustrated in FIG. 1, the shaft or center of percussion length is measured from the free end of the grip portion 24 to the center of percussion of the club head 26. Once the mass "M" and the shaft or center of percussion length "Q" have been determined, the reference club 22 is balanced on a conventional fulcrum type device as illustrated in FIG. 3 in order to locate the center of gravity position for such club. When so balanced, the center of gravity location is marked on the club shaft and the distance "r" (FIG. 1) from the center of gravity location to the free end portion of the grip 24 is measured and determined. With respect to the selected reference club 22, we now know the mass "M" of the reference club, the shaft or center of percussion length "Q", and the distance "r" as illustrated in FIG. 1. Using the center of percussion equation $Q=K^2/r$, the radius of gyration "K" can now be calculated for the reference club 22. Having determined the radius of gyration for the selected reference club, this radius of gyration value will now be the basis for balancing all of the remaining clubs in any particular set or other club grouping.

Figure 4:
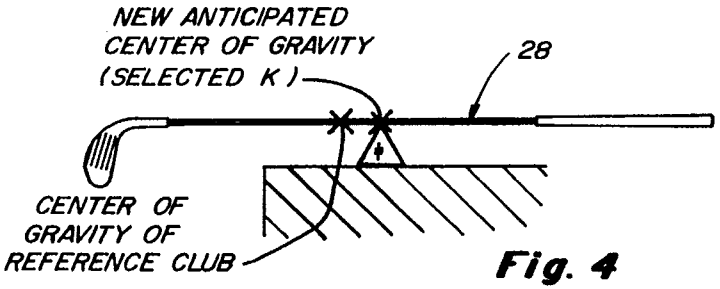
FIG. 4 is a side elevational view of a typical fulcrum device similar to FIG. 3 illustrating the weighting and balancing of a particular golf club at its new anticipated center of gravity location based upon a selected radius of gyration value.

The remaining club or clubs to be balanced can now be assembled and the longest club in that particular set or grouping of clubs to be balanced, be it the driver or some other club, is identified. The shaft or center of percussion length "Q" is now measured for this longest club to be balanced. Again, using the center of percussion equation, $Q\text{-}K^2/r$ the distance "r" representing the new center of gravity location for the longest club to be balanced based upon the selected radius of gyration value determined for the reference club can now be calculated. Once the new center of gravity location for the longest club to be balanced, such as the club 28 illustrated in FIG. 4, has been determined, this longest club can now be balanced in a conventional manner at its new center of gravity location as calculated above and as illustrated in FIG. 4. The precise manner for balancing the longest club 28 at its new center of gravity location by adding weight to the grip end portion thereof is fully explained in Applicant's U.S. Pat. No. 5,094,101. In essence, as illustrated in FIG. 4, with the fulcrum device located at the new center of gravity location, additional weight is added adjacent the grip end portion of the club in order to balance such club in equilibrium about the new center of gravity position. At this point, the longest club in the particular set or club grouping to be balanced is now dynamically balanced to the radius of gyration of the reference club.

Once the longest club in the particular set or plurality of clubs to be balanced has been dynamically balanced to the selected radius of gyration of the reference club, this club is then positioned on a conventional swing weight scale device such as the device 10 illustrated in FIG. 1 and a corresponding or correlating swing weight scale reading or designation is determined for such club. This is achieved by slidably moving the weight 16 along the calibrated scale 18 until the club is balanced in equilibrium about the fulcrum or pivot point 20. We have now established a correlation between the selected radius of gyration and the swing weight scale designation for the longest club in any particular set or plurality of clubs to be balanced in accordance with the present method. Instead of tediously calculating the new center of gravity locations for each of the remaining clubs to be balanced and thereafter tediously balancing each of such remaining clubs on a conventional fulcrum device as illustrated in FIG. 4 and as explained in Applicant's U.S. Pat. No. 5,094,101, the present method circumvents this more tedious and time consuming method for dynamically balancing golf clubs and enables one to considerably simplify the radius of gyration balancing process by balancing the remainder of the particular set or group of remaining golf clubs to be balanced on a swing weight scale using the correlation just determined between the selected radius of gyration value and the corresponding or correlated swing weight scale designation or reading for the longest club to be balanced.

With the correlation between radius of gyration value and swing weight scale designation already established for the longest club to be balanced, several options exist for balancing the remaining clubs depending upon the degree of accuracy desired in holding the radius of gyration values for all such clubs substantially constant. For example, if a set or plurality of golf clubs were dynamically balanced in accordance with Applicant's U.S. Pat. No. 5,094,101 wherein each club so balanced was balanced to the same radius of gyration; and if each such radius of gyration balanced club was thereafter swing weighted on a conventional swing weight scale device or calibrated fulcrum such as the device 10 illustrated in FIG. 1, the swing weight scale designations corresponding to each such club in such set will be incrementally different for each such club even though the radius of gyration for each such club would be identical. It has also been found that the incremental change in swing weight scale designations may not be uniform from the longest club to the shortest club in the particular set to be balanced. This means that if one is to achieve identical uniformity in the radius of gyration value for all such clubs to be balanced, an identical set of golf clubs could be swing weighted to the same identical swing weight scale designations associated with a particular reference set of golf clubs after such reference set of golf clubs were dynamically balanced and swing weight correlated as explained above. This assumes that each golf club in the set of golf clubs to be balanced is substantially identical in weight, length and weight distribution as compared to the corresponding club in the reference set. Such a balancing would theoretically produce a set or plurality of golf clubs dynamically balanced to the same radius of gyration by balancing such golf clubs on a conventional swing weight scale device to their respective corresponding, correlated radius of gyration/swing weight scale designation reading. This balancing is accomplished by positioning the right edge portion of the slide weight 16 at the correct swing weight designation for the particular club being balanced and thereafter adding weight to the grip end portion of such club in order to balance such club in equilibrium on the swing weight scale device 10 about the fulcrum or pivot point 20. One method for adding weight to the grip end portion of such club during the balancing process is fully explained in U.S. Pat. No. 5,094,101 and any other suitable method for accomplishing this task can be utilized. Obviously, in this particular situation, the reference set of golf clubs would have to be dynamically balanced in accordance with Applicant's U.S. Pat. No. 5,094,101. However, all additional, substantially identical sets of golf clubs could then be dynamically balanced to the same radius of gyration as the reference set of golf clubs by using the above-referenced specific radius of gyration/swing weight scale designation correlation. Since no two golf clubs can ever be manufactured identically in every respect, it is recognized that some slight variation in radius of gyration value may still occur when exercising this option of the present invention.

Since the incremental change in swing weight scale designations for a plurality of clubs balanced to the same radius of gyration will not necessarily be uniform from the longest club to the shortest club in that particular set, it is possible to derive an average incremental change in such swing weight scale designation so as to achieve substantial uniformity, although, some acceptable variance or tolerance in the selected radius of gyration value may occur. For example, in a particular set of clubs to be balanced including a driver, 3 wood, irons 1 through 9 and a wedge, a review of the corresponding swing weight scale designations for the referenced set of clubs balanced at the selected radius of gyration may reveal that an average incremental change of approximately two swing weight scale points exist between the respective swing weight scale designations starting with the longest club and ending with the shortest club in the particular plurality of clubs to be balanced. This means that once the correlated swing weight scale designation for the longest club in the particular set or plurality of clubs to be balanced has been determined on a conventional calibrated fulcrum, all of the remaining clubs in such plurality can be balanced on the calibrated fulcrum starting with the longest club and ending with the shortest club by incrementally adding two units to the swing weight scale designation correlated for the longest club in such group. For example, if the correlated swing weight scale designation for the longest club is A-3, then the next longest club will be swing weighted to a scale designation of A-5, the next longest club will be swing weighted to a scale designation of A-7 and so forth. Although this method for dynamically balancing a set of golf clubs based upon a selected radius of gyration does not produce as accurate a balancing method as that described above, this compromised method still produces a better matched set of golf clubs than any of the known swing weighting methods and, importantly, such method represents a dynamic balancing of such clubs as compared to the static balancing produced using conventional swing weighting techniques.

Still further, although not as accurate as the two above-identified balancing methods, it is also advantageous to balance the remainder of the plurality of golf clubs to be balanced on the swing weight scale device at the same swing weight designation reading as determined for the longest club in such plurality. In the example given above, if the correlated swing weight scale designation for the longest club in a particular set to be balanced in accordance with the present method was A-3, then all of the remaining clubs in the particular set or grouping to be balanced would then be swing weighted to the same A-3 scale designation. In this particular situation, the radius of gyration associated with each such club will not remain constant but will vary as discussed above. Nevertheless, even though the radius of gyration for such clubs do, in fact, vary, the range of radius of gyration values associated with such clubs is still well within an acceptable and usable tolerance limit as compared to the selected radius of gyration for the longest club in such set. This means that such a balancing method will still produce a dynamically balanced plurality of clubs wherein the radius of gyration values associated respectively therewith are still considerably reduced and driven much closer to the selected radius of gyration value of the reference club.

It is important to recognize that when any particular set or plurality of golf clubs are balanced on a conventional swing weight scale device to a selected radius of gyration in accordance with the present methods, correlated swing weight scale designations in the range of A-0 to C-4 are achieved for the longer clubs. Swing weight scale readings in this range have never before been used in conventional swing weighting methods. This is possible because the present balancing method has limited effect on the center of percussion location associated with each respective club. In fact, with the present method, it is possible to swing weight a golf club below the A-0 swing weight scale reading. As a result, it is anticipated that the conventional swing weight scale readings can be extended to the right of the A-0 reading as illustrated in FIG. 2. In this regard, it is anticipated that a Z-0 to Z-9 range can be added to the swing weight scale 18. It is also recognized that other ranges may likewise be added to the right of the conventional A-0 swing weight scale designation, if necessary.

The correlation between swing weight scale designation and radius of gyration is best illustrated by a sequence formula developed by the inventor. The following equations are involved in this correlation.

(1) $SW = W \times L$ (swing weight equation)

where:

$SW$ = swing weight static moment;

$W$ = total weight of club; and $L$ = distance between fulcrum or pivot point of swing weight scale device and the center of gravity of a particular golf club positioned thereon as best illustrated in FIG. 1.

(2) $r = L + P$ (center of gravity equation)

where:

$r$ = distance between grip end portion of the club and the center of gravity (see FIG. 1);

$L$ = distance between fulcrum or pivot point of swing weight scale device and the center of gravity of a particular golf club positioned thereon as best illustrated in FIG. 1.; and $P$ = the fixed distance from the grip end portion of the club to the fulcrum or pivot point of the swing weight scale device (see FIG. 1).

(3) $r \times Q = K^2$ (center of percussion equation)

where:

$r$ = distance between grip end portion of the club and the center of gravity (see FIG. 1);

$Q$ = center of percussion length; and $K$ = radius of gyration.

(4) $I = K^2 \times M$ (moment of inertia equation)

where:

$I$ = moment of inertia;

$K$ = radius of gyration; and $M$ = mass of the club.

The four above-identified equations produce the following sequence formula.

SEQUENCE FORMULA $$SW = W \times L$$

$$L + P = r$$

$$r \times Q = K^2$$

$$K^2 \times M = K^2 \times (W/g) = I$$

From a review of the above-identified sequence formula, the correlation between swing weight static moment and the radius of gyration can be easily followed. The swing weight equation is linked to the moment of inertia equation by the center of percussion equation and the center of percussion equation is linked to the swing weight equation by "r", the center of gravity equation. Also, importantly, the center of percussion equation and the moment of inertia equation are linked by the radius of gyration. As one can see, the above-described equations are naturally linked from the swing weight equation to the moment of inertia equation and the above-explained sequence describes the balancing of golf clubs dynamically on a swing weight scale device to a specific radius of gyration that is identified by a particular swing weight designation reading. Since the swing weight static moment is calibrated on a swing weight scale device (calibrated fulcrum) to a specific swing weight scale designation or reading as described above and as referenced with respect to FIGS. 1 and 2, each swing weight static moment corresponds to a specific swing weight scale designation/radius of gyration for a club having a particular weight and length. This is illustrated in the table set forth above in the background of the present invention correlating swing weight scale designations to various static moment values. It is therefore possible to develop a table for each club in a particular set of clubs to be balanced correlating the swing weight scale designation with a selected radius of gyration using the parameters set forth above in the sequence formulation. Such a table would look as follows:

SEQUENCE FORMULA TABLE

| Club | SW Designation | W | L | P | r | Q | $K^2$ | M (W/g) | I | K |
|---|---|---|---|---|---|---|---|---|---|---|
| Driver | | | | | | | | | | |
| 3 Wood | | | | | | | | | | |
| 5 Wood | | | | | | | | | | |
| 1 | | | | | | | | | | |
| 2 | | | | | | | | | | |
| . | | | | | | | | | | |
| . | | | | | | | | | | |
| . | | | | | | | | | | |

Since many of the parameters set forth in the above-identified table can be easily obtained for any given golf club such as the center of percussion length, the distance P which is fixed for a given swing weight scale or calibrated fulcrum device, the center of gravity length, and the weight of a particular club, the other parameters in the present sequence formula can be easily calculated. Importantly, the above-derived sequence can be started at either end of the above-referenced table, that is, one can start with a swing weight designation and calculate the other parameters including the radius of gyration, or one can select the radius of gyration and calculate the corresponding swing weight scale designation. This is true regardless of which of the present method options described above one utilizes in order to achieve a dynamic balance. For example, if a user desires to balance all of the remaining clubs in a particular set or group of clubs on the swing weight scale device at the same swing weight designation reading as determined for the longest club in such grouping, the swing weight designation for all such clubs will be fixed and the remaining parameters identified in the Sequence Formula Table set forth above can be calculated or determined including the addition or subtraction of additional weight to the grip end portion of the particular club to balance such club at the selected swing weight scale designation which, in turn, corresponds to a selected radius of gyration. Similarly, if a user were to balance all clubs in a particular grouping to the selected radius of gyration value for the reference club, the above-described sequence formula would allow one to work backwards so as to identify the swing weight scale designation corresponding to the selected radius of gyration for each particular club. The above-referenced sequence formula therefore provides a static swing weight balance and a radius of gyration dynamic balance for all clubs in a particular set of clubs to be balanced for any given length of club. This sequence formulation provides that a swing weight scale designation above or below a reading of A-0 has a particular correlated radius of gyration value associated therewith for each such designation at a specified club length. Although the required balance weight can be determined mathematically from the above sequence formula, it is more practical to balance the remaining clubs in a particular set or grouping to be balanced on the swing weight scale device as indicated above to the selected swing weight scale designation and thereafter add such additional balance weight to the grip end portion of the club as indicated above.

It is important to recognize that the present method takes into account the amount of balance weight added to a particular club and this, in turn, does have a limited effect on the center of percussion associated with each respective club. This limit is defined in the $K^2/r$ ratio which is fully explained in Applicant's U.S. Pat. No. 5,277,059 which is specifically directed to a method for dynamically balancing golf putters and other implements using radius of gyration as the controlling parameter. As more fully explained in U.S. Pat. No. 5,277,059, the center of percussion location is quite stable as long as the $K^2/r$ ratio remains the same. At a certain club weight, or low swing weight designation, the $K^2/r$ ratio changes and the center of percussion location shifts upwards towards the club shaft and up the club shaft as previously explained in U.S. Pat. No. 5,277,059. Since $Q=K^2/r$ (center of percussion equation) and $K^2=Ig/W$ (moment on inertia equation), it is clear that the weight of a particular club is tied to its center of percussion length and, as a result, a change in club weight can result in a change of center of percussion length if other parameters remain constant. Also, importantly, it is clear that both the center of percussion length and the weight of a particular golf club are likewise tied to radius of gyration. Therefore, adding balance weight to a particular club in order to dynamically balance such club in accordance with the present method is, in fact, radius of gyration controlled as explained above and as more fully set forth in U.S. Pat. No. 5,277,059. Since adding balance weight to any particular club may shift the center of percussion from its original location, it is possible to add too much weight to a particular club so as to shift its center of percussion location completely off of the face of the club head. When this occurs, too much balance weight has been added to the club and this results in unacceptable club performance. This addition of too much weight also defines the limit associated with adding balance weight to a particular club in accordance with the present method. This limit is reached when just enough weight is added to the grip side of a particular club so as to move the center of percussion slightly from its original location. As more fully explained in U.S. Pat. No. 5,277,059, it is possible to change both the radius of gyration value "K" as well as the center of gravity length "r" while still holding the ratio "$K^2/r$" constant or substantially constant thereby holding the center of percussion length "Q" at or near its desired location and, importantly, on the club head face. The center of percussion location is therefore a physical representation of the ratio "$K^2/r$". The present method limits the swing weight designation/radius of gyration correlation to only a slight movement of the center of percussion caused by a change in the ratio "$K^2/r$". It is important that the center of percussion not move upwards too much as club performance deteriorates rapidly.

Since the present method also allows one to keep track of the additional balance weight which must be added to the grip side of each club to be balanced in order to balance such club in equilibrium at a specific swing weight scale designation/radius of gyration value, a correlation also exists between the selected radius of gyration, the corresponding swing weight scale designation, and the amount of additional incremental weight which must be added to the particular clubs to be balanced in order to dynamically balance such clubs to the selected radius of gyration value. This correlation is easily discernible from the sequence formula table illustrated above. In this regard, it has been found that greater weight will have to be added to the longest club in any particular set or plurality of clubs to be balanced as compared to the shorter clubs in such set, and that the amount of additional weight which must be added to the remainder of such clubs to be balanced will decrease incrementally from the longest club to the shortest club in such grouping. This means that once the amount of additional balance weight which must be added to the longest club in any particular plurality of clubs has been determined in order to balance such longest club at the radius of gyration of the reference club, the remaining clubs in such plurality may thereafter be balanced by merely adding weight to the grip side of each of such club, such weight to be added being adjusted incrementally downwardly by club length based upon the additional balance weight added to the longest club in such plurality. In fact, such a weight balancing will produce swing weight designations for each such club when placed on a calibrated fulcrum in a range which is higher than that associated with the balanced longest club but yet lower than the original swing weight designation associated with that particular club being balanced. The original swing weight designation of the particular club being balanced represents its original radius of gyration value and the new swing weight designation of the balanced longest club represents the selected radius of gyration of the reference club. As can be seen, even though the radius of gyration for each of the remainder of the clubs to be balanced will vary, such a weight balancing method using radius of gyration as the controlling parameter still produces a dynamically balanced plurality of clubs wherein the radius of gyration values associated respectively therewith are still considerably reduced and driven much closer to the selected radius of gyration value for the reference club. So long as the swing weight scale designation of any one of the balanced clubs falls within the above-identified range, namely, a swing weight designation which is higher than the balanced longest club but yet lower than the original swing weight designation associated with the particular club so balanced, the objectives and advantages of the present method have been achieved.

The present invention therefore shows a precise relationship between a swing weight scale designation and a particular radius of gyration in a set of golf clubs that are identical in length, weight and weight distribution. However, realistically, very few sets of golf clubs are identical to each other in length, weight and weight distribution and this inaccuracy is reflected in varying swing weight scale readings and differences in radius of gyration values. This is true in conventional swing weighting techniques as well as in the present method of dynamically balancing golf clubs on a conventional swing weight scale using radius of gyration as the controlling parameter. Nevertheless, as indicated above, the present method is sufficiently accurate as compared to other known prior art balancing methods and teaches a more simplified method for accomplishing radius of gyration dynamic balancing using a conventional swing weight scale device as compared to Applicant's more involved and more tedious method for dynamically balancing golf clubs as disclosed in U.S. Pat. No. 5,094,101.

Of all of the various methods for balancing golf clubs that specifically add weight or weights to the grip side of a golf club, no prior art method adds enough weight to a particular club so as to yield to a swing weight scale designation below a scale reading of C-4. In total contrast to the multitude of prior art balancing methods, the present method balances golf clubs in the A-0 to C-4 swing weight designation range by adding sufficient weight to such clubs to reduce the center of gravity length (r) so that such clubs will, in fact, swing weight between A-0 and C-4 while simultaneously reducing the radius of gyration towards that asociated with the reference club. The present invention therefore encompasses adding weight to the grip side of any particular golf club in sufficient amounts such that when such golf club is balanced on a calibrated fulcrum, the swing weight scale designation for such golf club falls in the range of A-0 to C-4. Any weight or weights added to the grip side of a particular golf club, whether integral or non-integral to the particular grip or club shaft, or any other distribution of weight in a particular golf club that produces a A-0 to C-4 swing weight scale reading when such club is placed on a calibrated fulcrum is considered to be within the scope of the present invention.

Thus, there has been shown and described a novel method for dynamically balancing golf clubs, which method fulfills all of the objects and advantages sought therefor. Many changes, modifications, variations, and other uses and applications of the present method will, however, become apparent to those skilled in the art after considering this specification and the accompanying drawings. All such changes, modifications, variations, and other uses and applications which do not depart from the spirit and scope of the invention are deemed to be covered by the invention which is limited only by the claims which follow.

What is claimed is:

1. A method for balancing a plurality of golf clubs, said method comprising the following steps:

(a) having a golfer select a reference club;

(b) determining the radius of gyration of said reference club;

(c) selecting the longest club in the particular plurality of golf clubs to be balanced;

(d) determining the center of percussion length of the longest club in the particular plurality of golf clubs to be balanced;

(e) determining the new anticipated center of gravity location for the longest club to be balanced using the radius of gyration determined for said reference club;

(f) balancing the longest club in the plurality of golf clubs to be balanced about its new anticipated center of gravity location so as to give such club the same radius of gyration as said reference club;

(g) placing the balanced longest club on a calibrated fulcrum scale device and obtaining the corresponding swing weight scale designation for such balanced longest club; and (h) balancing each of the remainder of said plurality of golf clubs on a calibrated fulcrum at the same swing weight scale designation as determined for the balanced longest club in said plurality of golf clubs.

2. A method for dynamically balancing a plurality of golf clubs wherein each of said plurality of golf clubs are balanced to the same radius of gyration, said method comprising the following steps:

(a) selecting a predetermined radius of gyration value;

(b) selecting a reference plurality of clubs to be balanced to the selected radius of gyration;

(c) determining the center of percussion length associated with each club in said reference plurality of clubs;

(d) determining the new anticipated center of gravity location for each club in said reference plurality of clubs using the selected radius of gyration value;

(e) balancing each of said reference plurality of clubs at its respective new anticipated center of gravity location;

(f) placing each of said reference plurality of clubs on a calibrated fulcrum and obtaining the corresponding swing weight scale designation for each such club;

(g) obtaining a second plurality of golf clubs wherein each club in said second plurality of clubs corresponds substantially in length and weight with at least some of the golf clubs in said reference plurality of clubs; and (h) balancing any one of the clubs in said second plurality of golf clubs on a calibrated fulcrum to the same swing weight scale designation as determined for the corresponding club in said reference plurality of golf clubs.

3. A method for balancing a plurality of golf clubs comprising the following steps:

(a) having a golfer select a reference club;

(b) determining the radius of gyration of said reference club;

(c) selecting the longest club out of said plurality of golf clubs to be balanced;

(d) determining the new center of gravity location for the longest club in said plurality of clubs to be balanced using the radius of gyration of said reference club;

(e) balancing the longest club in said plurality of clubs at its new center of gravity location using the radius of gyration of said reference club;

(f) placing the balanced longest club of said plurality of clubs on a calibrated fulcrum and obtaining a corresponding swing weight scale designation for said balanced longest club; and (g) balancing each of the remainder of said plurality of golf clubs on said calibrated fulcrum at a swing weight scale designation which is adjusted incrementally by club length based upon the swing weight scale designation associated with the longest club in said plurality of clubs and the club length associated with the particular club being balanced.

4. The method defined in claim 3 wherein the incremental adjustment in swing weight scale designations from one club to the next in descending club length order is substantially uniform.

5. The method defined in claim 3 wherein the incremental adjustment in swing weight scale designations from one club to the next in descending club length order is non-uniform.

6. The method defined in claim 3 wherein the incremental adjustment in swing weight scale designations from one club to the next in descending club length order is selected based upon balancing each of the remainder of said plurality of golf clubs to substantially the same radius of gyration of the reference club.

7. A method for balancing a plurality of golf clubs comprising the following steps:

(a) having a golfer select a reference club;

(b) determining the radius of gyration of said reference club;

(c) selecting the longest club out of said plurality of golf clubs to be balanced;

(d) determining the new center of gravity location for the longest club in said plurality of clubs to be balanced using the radius of gyration of said reference club;

(e) balancing the longest club in said plurality of clubs at its new center of gravity location using the radius of gyration of said reference club;

(f) determining the amount of additional balance weight which was added to the longest club of said plurality of clubs in order to balance said longest club using the reference radius of gyration;

(g) placing the balanced longest club of said plurality of clubs on a calibrated fulcrum and obtaining a corresponding swing weight designation for said balanced longest club;

(h) placing each of the remainder of said plurality of golf clubs on a calibrated fulcrum and obtaining the original swing weight designation for each such club; and (i) adding weight to the grip side of each of the remainder of said plurality of golf clubs, said weight to be added being adjusted incrementally downwardly by club length based upon the additional balance weight added to the longest club in said plurality of clubs such that when each of the remainder of said plurality of clubs is thereafter positioned on a calibrated fulcrum, the swing weight designation associated with each such remainder of clubs falls within a range of swing weight designations which is higher than that associated with said balanced longest club but lower than the original swing weight designation associated with the particular club being balanced.

8. The method defined in claim 7 wherein the incremental adjustment in balance weight from one club to the next in descending club length order is substantially uniform.

9. The method defined in claim 7 wherein the incremental adjustment in balance weight from one club to the next in descending club length order is non-uniform.

10. The method defined in claim 7 wherein the incremental adjustment in balance weight from one club to the next in descending club length order is selected based upon balancing each of the remainder of said plurality of golf clubs to substantially the same radius of gyration of the reference club.

11. A method for dynamically balancing a golf club comprising adding weight to the grip side of said golf club in sufficient amounts such that when said golf club is balanced on a swing weight scale device, the swing weight scale designation for said golf club falls in the range of A-0 to C-4, the swing weight scale designations A-0 to C-4 representing scale readings on the swing weight scale device, each of said scale readings corresponding to a specific static moment value depending upon the particular swing weight scale device being used.

* * * * *

UNITED STATES PATENT AND TRADEMARK OFFICE

CERTIFICATE OF CORRECTION

PATENT NO. : 5,417,108

DATED : May 23, 1995

INVENTOR(S) : Herman A. Chastonay

It is certified that error appears in the above-indentified patent and that said Letters Patent is hereby corrected as shown below:

Column 5, line 17, "Elkin+" should be --Elkins'--.

Column 9, line 27, "$Q-K^2/r$" should be --$Q=K^2/r$--.

Signed and Sealed this

Twenty-fifth Day of July, 1995

*Attest:*

*Attesting Officer*

BRUCE LEHMAN

*Commissioner of Patents and Trademarks*